US005628458A

United States Patent [19]

Kuo

[11] Patent Number: 5,628,458

[45] Date of Patent: May 13, 1997

[54] SPRAY TUBE ASSEMBLY FOR OSCILLATING SPRINKLERS

[76] Inventor: Yu-Neng Kuo, No. 10, Fang-Tung Rd., Wen-Lu Town, Fang-Yuan Hsiang, Chang-Hwa Hsien, Taiwan

[21] Appl. No.: 420,781

[22] Filed: Apr. 12, 1995

[51] Int. Cl.[6] ..... B05B 3/16

[52] U.S. Cl. ..... 239/242; 239/447; 239/564; 239/581.1

[58] Field of Search ..... 239/242, 446, 239/447, 443, 444, 581.1, 566, 562–564

[56] References Cited

U.S. PATENT DOCUMENTS 615,486 12/1898 Jendis ..... 239/566 X
804,968 11/1905 Miller ..... 239/566 X
3,423,024 1/1969 Morawetz ..... 239/242
5,052,622 10/1991 Lindermeir et al. ..... 239/242
5,350,115 9/1994 Burnsworth et al. ..... 239/242

*Primary Examiner*—Kevin Weldon
*Attorney, Agent, or Firm*—Bacon & Thomas

[57] ABSTRACT

A spray tube assembly including a spray tube mounted on the base of an oscillating sprinkler and oscillated by an oscillating control device, and an inner tube inserted into the spray tube and having two symmetrical sets of sector water stoppers mounted around the periphery, the sector water stoppers having respective peripheries extended to different angles, wherein turning the inner tube within the spray tube causes the sector water stoppers to alternatively stop or open the jet nozzles on the spray tubes.

2 Claims, 6 Drawing Sheets

SPRAY TUBE ASSEMBLY FOR OSCILLATING SPRINKLERS

BACKGROUND OF THE INVENTION

The present invention relates to oscillating sprinklers, and relates more particularly to the spray tube assembly for an oscillating sprinkler which comprises a spray tube and an inner tube inserted into the spray tube and turned to alternatively open and close the jet nozzles on the spray tube.

Various oscillating sprinklers have been developed for sprinkling water over the lawn. FIG. 1 shows an oscillating sprinkler according to the prior art which comprises a base and a spray tube mounted on the base and turned back and forth by an oscillating control device. When water is guided to the oscillating sprinkler, it is driven out of the spray tube through the jet nozzles on the spray tube when the spray tube is turned back and forth. Because the jet nozzles of the spray tube cannot be alternatively closed and opened, the water spraying area of the oscillating sprinkler is not adjustable. FIG. 2 shows another structure of oscillating sprinkler in which a polygonal sleeve is mounted around the spray tube, having a plurality of nozzle strips with jet nozzles at each side. By changing the angular position of the polygonal sleeve relative to the spray tube, the jet nozzles on the spray tube are alternatively opened and closed, and therefore the water spraying area of the oscillating sprinkler is adjusted. Because the nozzle strips are respectively fastened to the polygonal sleeve by a high-frequency heat sealing process, the complicated assembly process greatly increases the manufacturing cost of the oscillating sprinkler.

SUMMARY OF THE INVENTION

According to the preferred embodiment of the present invention, the spray tube assembly comprises a spray tube mounted on the base of an oscillating sprinkler and oscillated by an oscillating control device, and an inner tube inserted into the spray tube and having two symmetrical sets of sector water stoppers mounted around the periphery and extended to different angles, wherein turning the inner tube within the spray tube causes the sector water stoppers to alternatively stop or open the jet nozzles on the spray tubes.

DETAILED DESCRIPTION OF THE PREFERRED EMBODIMENT

Figure 1:
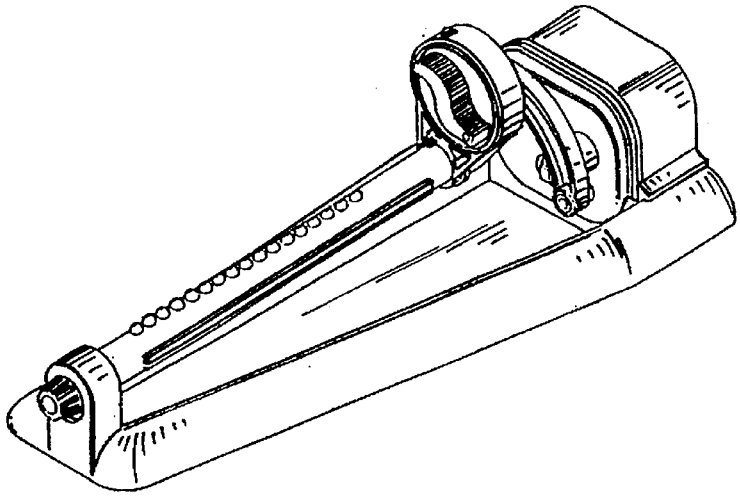
Fig. 1 PRIOR ART
FIG. 1 is an elevational view of an oscillating sprinkler according to the prior art.
Figure 2:
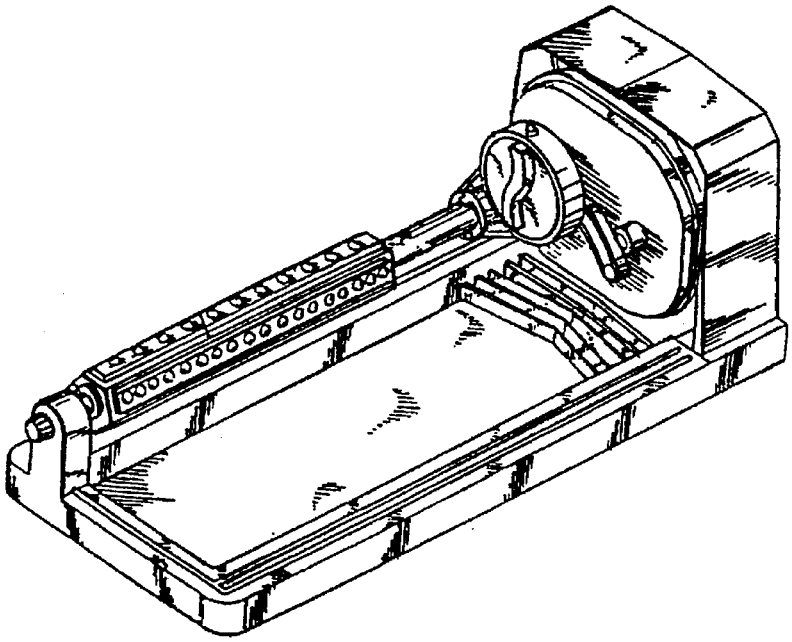
Fig. 2 PRIOR ART
FIG. 2 is an elevational view of another structure of oscillating sprinkler according to the prior art.
Figure 3A:
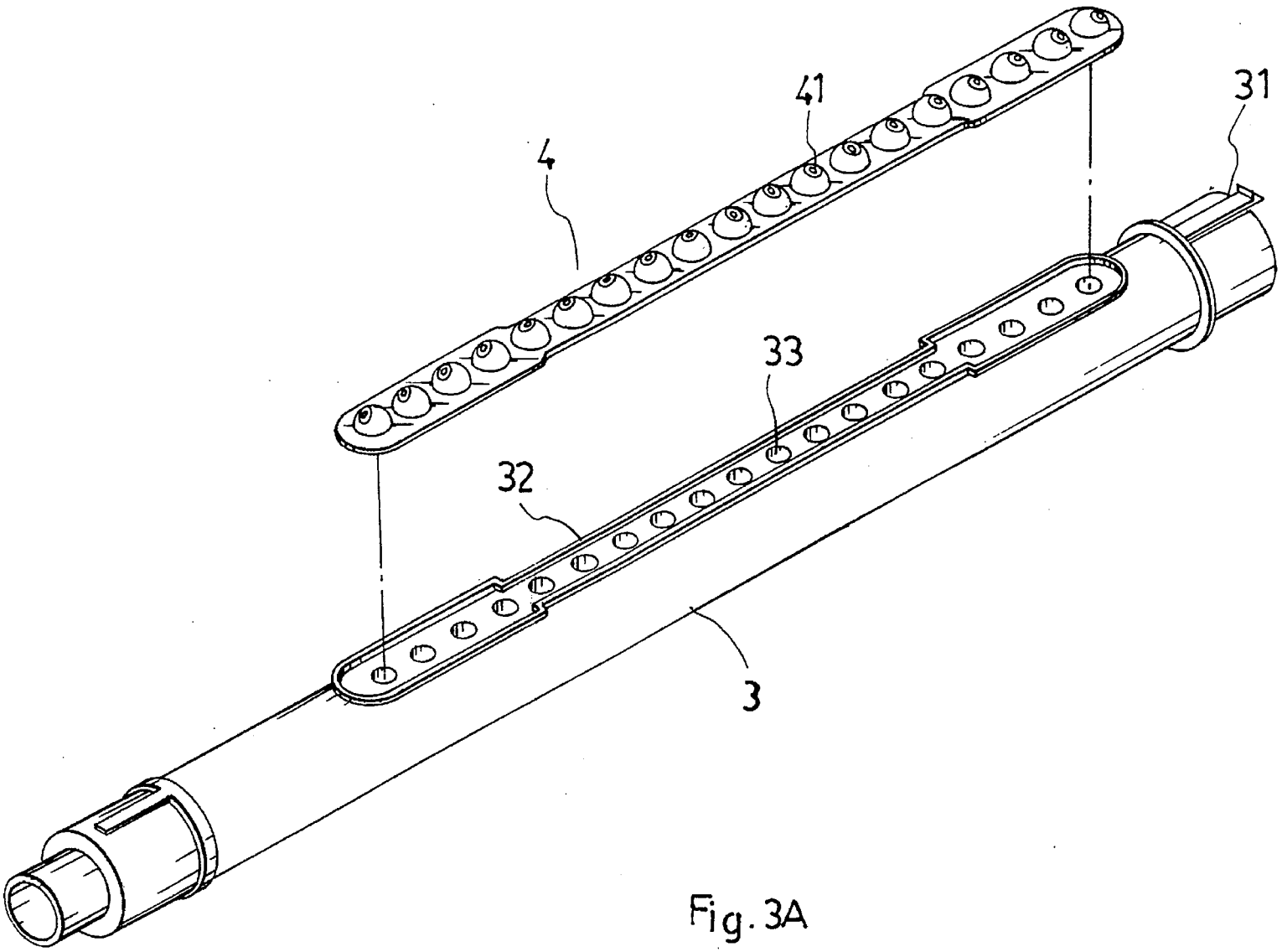
FIG. 3A is an exploded view of a spray tube according to the present invention.

Referring to FIG. 3A, the spray tube, referenced by 3, comprises a longitudinal hook 31 at one end, and a longitudinal series of water outlets 33 surrounded by a flange 32, which raises from the outside wall of the spray tube 3. An elongated nozzle plate 4 is mounted within the flange 32, having a longitudinal series jet nozzles 41 respectively communicated with the water outlets 33 on the spray tube 3.

Figure 3B:
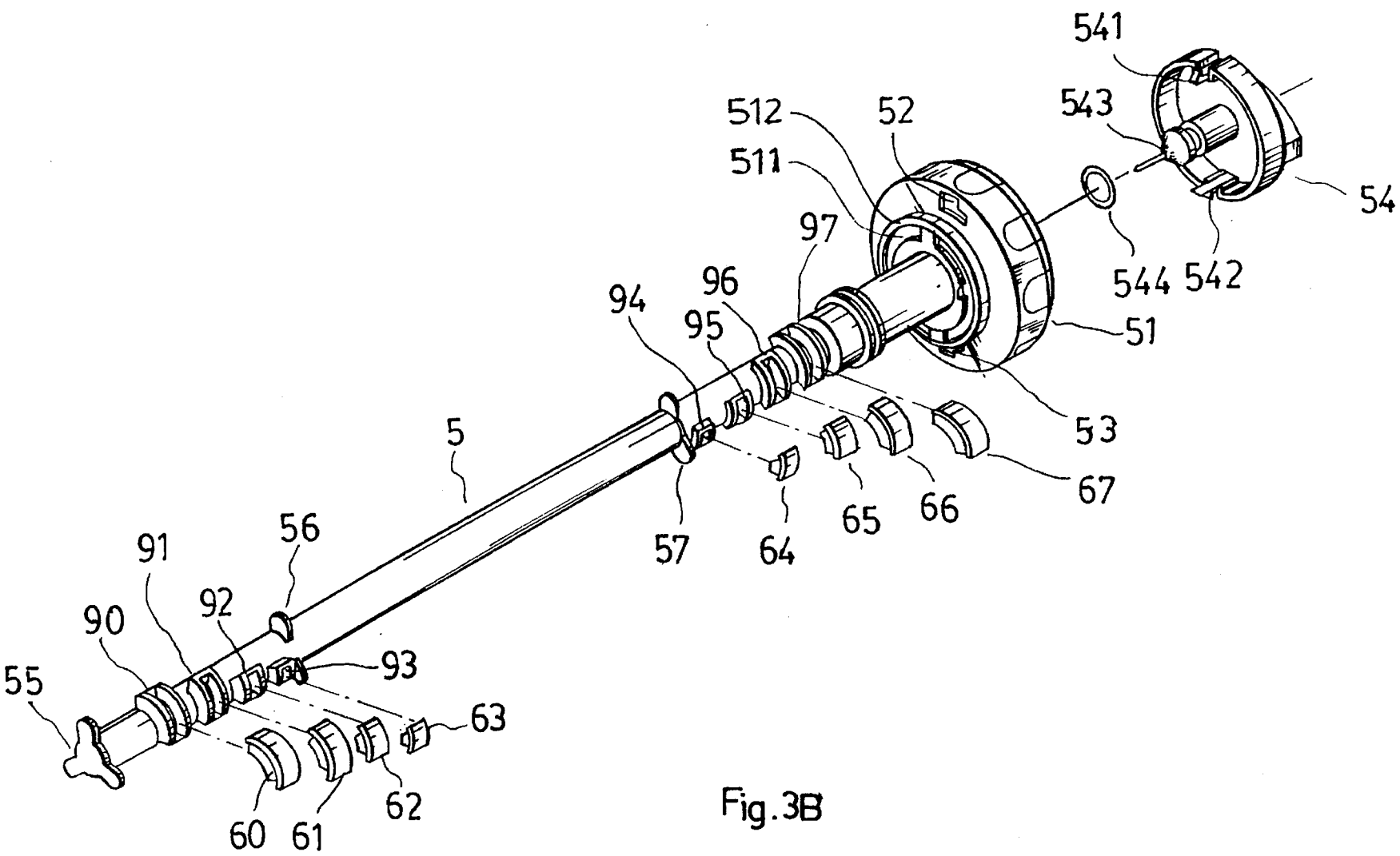
FIG. 3B is an exploded view of an inner tube according to the present invention.

Referring to FIG. 3B, the inner tube, referenced by 5, comprises an end cup 51 at one end, which has two symmetrical retaining holes 52 and 53, a knob 54 having two symmetrical hooks 541 and 542 respectively fastened to the retaining holes 52 on the end cup 51 and a plug rod 543 at the center mounted with a stop ring 544 and inserted into the inner diameter (not shown) of the inner tube 5, a first stop plate 55 at an opposite end, a second stop plate 56 radially raised from the periphery and disposed at about one fourth of the length of the inner tube 5 measuring from the first stop plate 55, a third stop plate 57 radially raised from the periphery and disposed at about three fourth of the length of the inner tube 5 measuring from the first stop plate 55 for supporting tube 3, a plurality of sector holder blocks from 90–97 fixedly secured to the periphery at different angles, and a plurality of sector water stoppers from 60–67 respectively fastened to the sector holder blocks 90–97. The sector holder blocks 90–97 include a first sector holder block 90, a second sector holder block 91, a third sector holder block 92, a fourth sector holder block 93, a fifth sector holder block 94, a sixth sector holder block 95, a seventh sector holder block 96, and an eighth sector holder block 97. The first sector holder block 90, the second sector holder block 91, the third sector holder block 92 and the fourth sector holder block 93 are spaced from one another between the first stop plate 55 and the second stop plate 56 and respectively extended with respective peripheries to the angles of 105°, 69°, 40° and 35°; the fifth sector holder block 94, the sixth sector holder block 95, the seventh sector holder block 96 and the eighth sector holder block 97 are spaced from one another between the third stop plate 57 and the end cap 51 and respectively extended with respective peripheries to the angles of 35°, 40°, 69° and 105°.

Figure 3C:
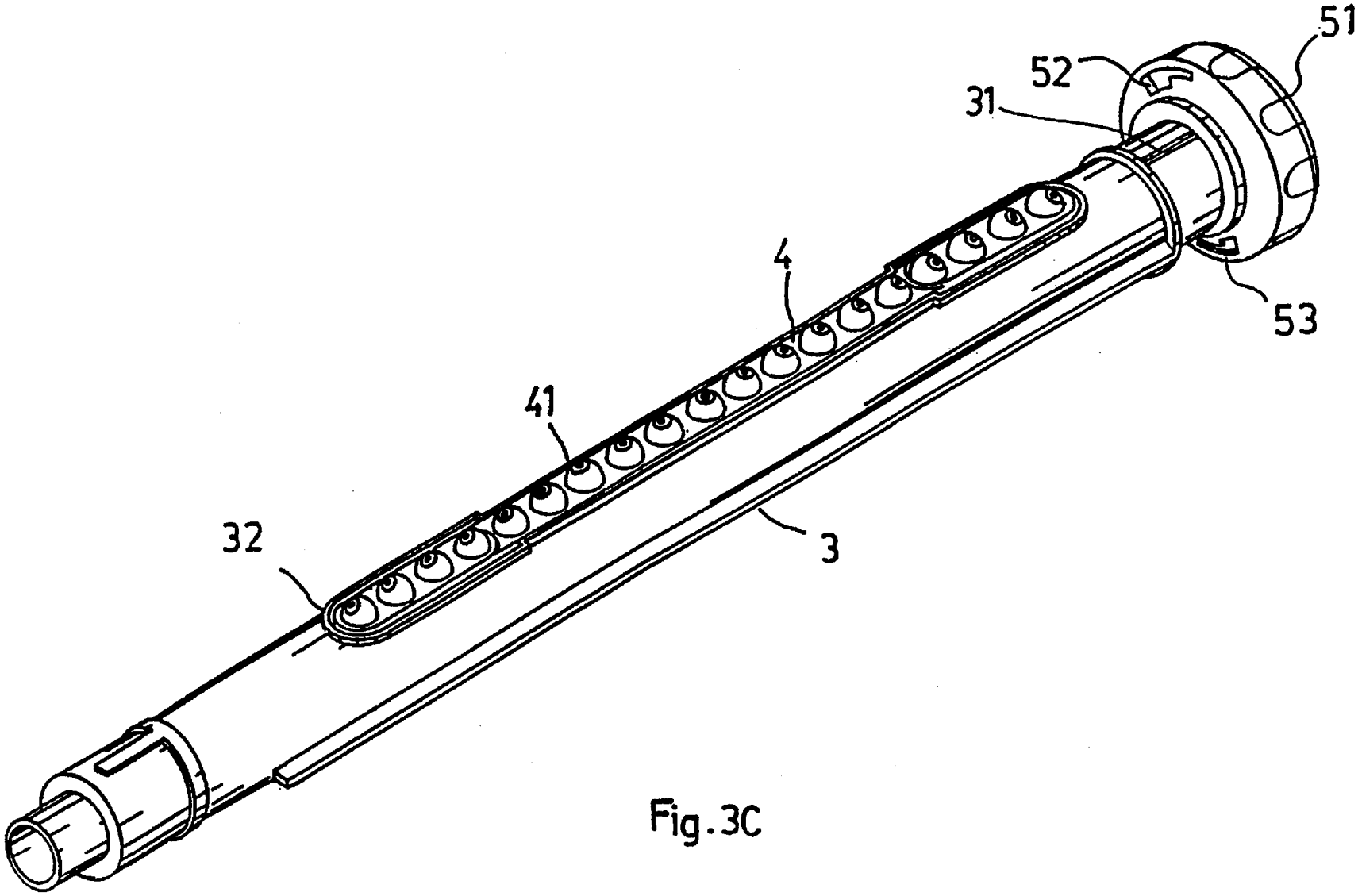
FIG. 3C is an elevational view of a spray tube assembly according to the present invention.
Figure 4:
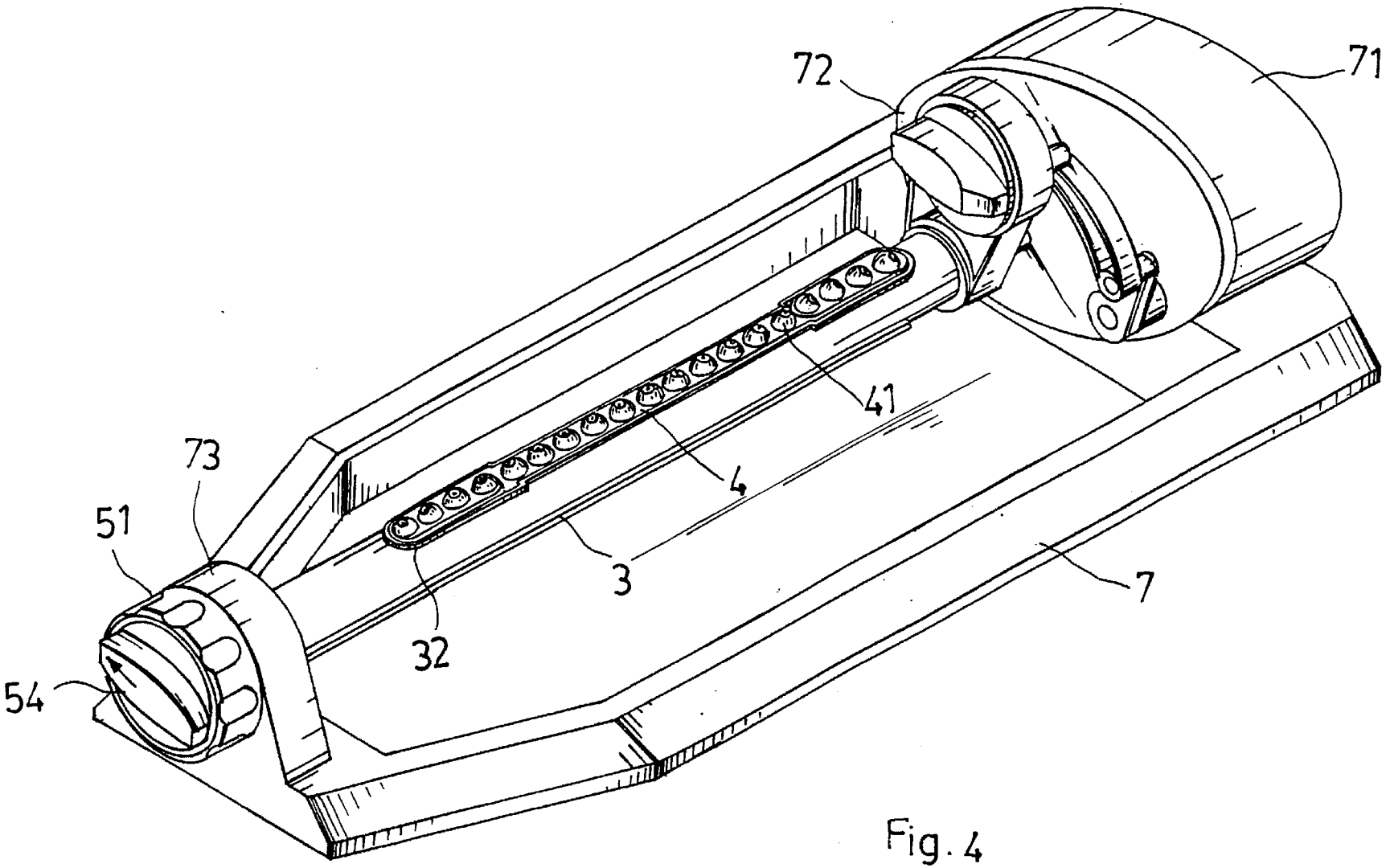
FIG. 4 shows the spray tube assembly of the present invention installed in the base of an oscillating sprinkler.

Referring to FIGS. 3C and 4, when the inner tube 5 is inserted into the spray tube 3, the end cup 51 is disposed outside the spray tube 3 and retained in plate by engagement of the longitudinal hook 31 of the spray tube 3 with flange 512 in channel 511. After the inner tube 5 is inserted into the spray tube 3, the spray tube 3 with the inner tube 5 is mounted on a base 7. The base 7 comprises an upright coupling block 71 at one end, an oscillating control device 72 mounted on the upright coupling block 71, and a supporting frame 73 at an opposite end. When the spray tube 3 with the inner tube 5 are mounted on the base 7, the rear end (the end remote from the end cup 51) of the spray tube 3 is inserted into a hole (not shown) on the upright coupling block 71 and coupled to the oscillating control device 72, and the end cup 54 is extended out of a hole (not shown) on the supporting frame 73.

Figure 5:
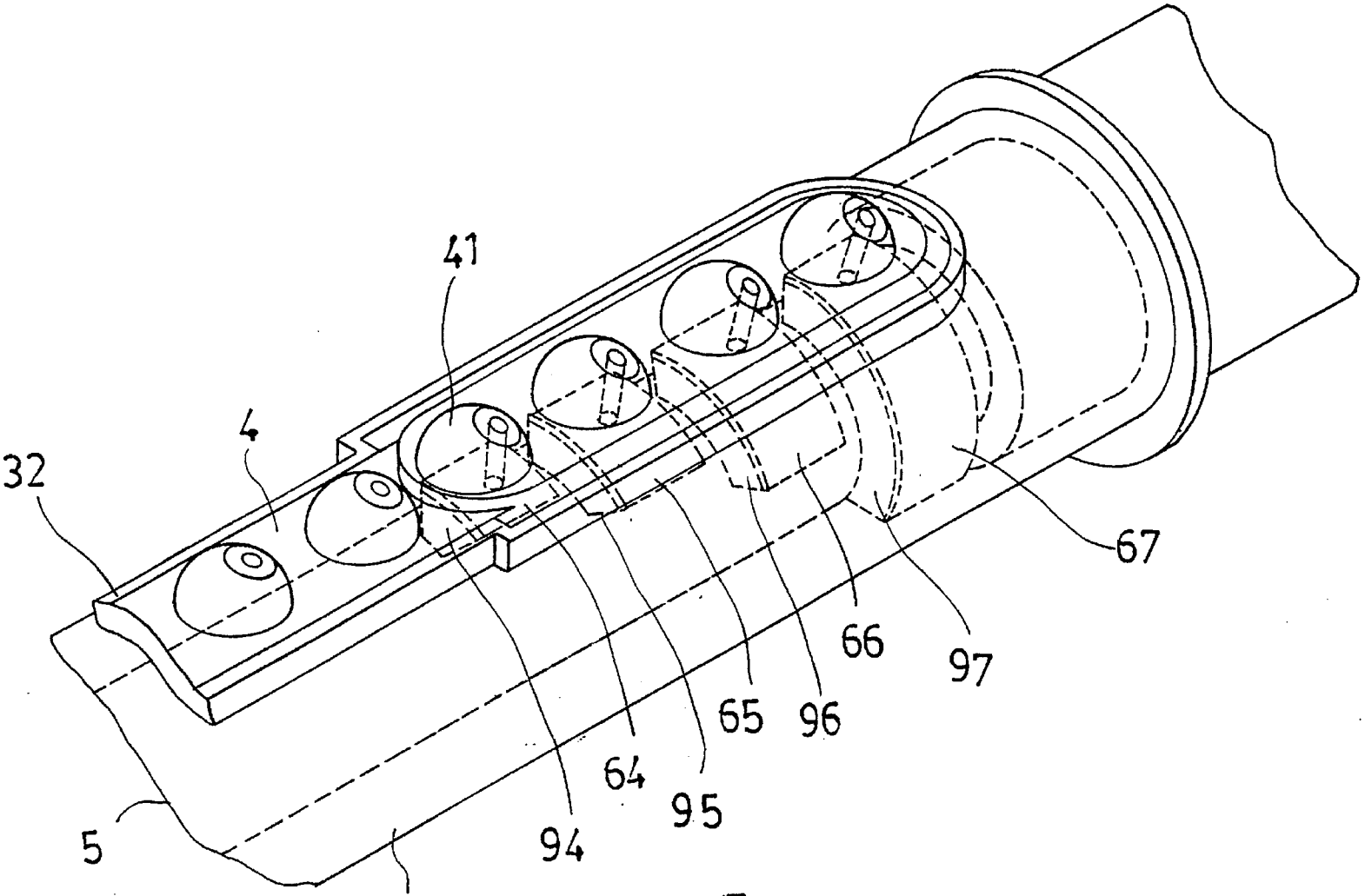
FIG. 5 is a perspective view in an enlarged scale of the spray tube assembly of the present invention, showing a plurality of jet nozzles stopped by respective sector water stoppers.

Referring to FIG. 5 and FIGS. 3 and 4 again, when the upright coupling block 71 of the base 7 is coupled to the water pipe (not shown), water is guided into the spray tube 3 and forced out of the jet nozzles 41 on the nozzle strip 4. When the inner tube 5 is turned by the knob 54 to a first position, namely, the 140° angle position, the first and last water outlets 33 are respectively stopped by the first sector water stopper 60 and the eighth sector water stopper 67. When the inner tube 5 is turned by the knob 54 to a second position, namely, the 105° angle position, the first and last water outlets and the second and last second water outlets 33 are respectively stopped by the first sector water stopper 60, the eighth sector water stopper 67, the second sector water stopper 61 and the seventh sector water stopper 66. In the similar manner, when the inner tube 5 is turned by the knob 54 to a different position, a different number of the water outlets 33 are stopped. Therefore, the water spraying area of the spray tube assembly can be adjusted by changing the position of the inner tube 5 relative to the spray tube 3.

I claim:

1. A spray tube assembly mounted on the base of an oscillating sprinkler and turned by an oscillating control device on said base to sprinkling water on a lawn, the spray tube assembly comprising:

a spray tube having a longitudinal hook at one end, an endless flange raised from the periphery, and a longitudinal series of water outlets surrounded by said endless flange;

an elongated nozzle plate mounted within said endless flange, having a longitudinal series of jet nozzles respectively communicating with said water outlets of said spray tube; and an inner tube inserted into said spray tube, said inner tube comprising and end cup at one end, a knob fixed to said end cup and turned to rotate said inner tube within said spray tube, a first stop plate at an opposite end, a second stop plate radially raised from the periphery and disposed at about one fourth of the length of said inner tube measuring from said first stop plate, a third stop plate radially raised from the periphery and disposed at about three fourth of the length of said inner tube measuring from said first stop plate, two symmetrical sets of sector holder blocks fixedly secured to the periphery and respectively disposed within the area between said first stop plate and said second stop plate and the area between said third stop plate and said end cup, and a plurality of sector water stoppers respectively fastened to said sets of sector holder blocks, said sector holder blocks being moved relative to said water outlets when said inner tube is turned within said spray tube by said knob, the sector water stoppers in each set of sector holder blocks covering different angles;

wherein said inner tube can be turned within said spray tube by said knob to move said sector water stoppers relative to said water outlets, causing said water outlets to be alternatively closed or opened.

2. The spray tube assembly of claim 1 wherein each set of sector holder blocks includes four sector holder blocks having respective peripheries extended to the angles of 105°, 69°, 40° and 35° respectively.

* * * * *